US005324405A

United States Patent [19]

Doniguian

[11] Patent Number: 5,324,405

[45] Date of Patent: Jun. 28, 1994

[54] PULSE CATHODIC PROTECTION SYSTEM

[76] Inventor: Thaddeus M. Doniguian, 913 Emerald Bay, Laguna Beach, Calif. 92651

[21] Appl. No.: 756,617

[22] Filed: Sep. 9, 1991

[51] Int. Cl.[5] ..... C23F 13/00

[52] U.S. Cl. ..... 204/196; 204/147; 204/197

[58] Field of Search ..... 204/147, 148, 196, 197

[56] References Cited

U.S. PATENT DOCUMENTS 3,612,898 12/1971 Doniguian et al. ..... 204/196

3,692,650 9/1972 Kipps et al. ..... 204/147

OTHER PUBLICATIONS

Declaration of inventor Thaddeus M. Doniguian concerning experimental work performed by applicant Pursuant to Rule 37 CFR S1.56.

*Primary Examiner*—T. Tung

*Attorney, Agent, or Firm*—Harold L. Jackson

[57] ABSTRACT

A circuit and method of cathodically protecting ferrous metal structures such as pipelines or well casings is described disposed in a conductive medium such as the ground. A pair of terminals are connected to an anode spaced from the structure and to the structure. A source of d.c. voltage is periodically connected across the terminal to cause current to flow to the anode and provide electrons at the surface of the structure to inhibit ferrous molecules from going into solution and damaging the integrity of the structure. The current flow due to the induced emf caused by the reactive inductions of the anode/cathode system is limited to inhibit damage to neighboring ferrous structures by providing a high impedance, e.g. an open circuit, between the input terminals during all or part of the time that the d.c. source is not supplying current to the anode/cathode load.

10 Claims, 3 Drawing Sheets

PULSE CATHODIC PROTECTION SYSTEM

BACKGROUND OF THE INVENTION a. Field of the Invention

This invention relates to a method and apparatus for the cathodic protection of a structure such as a pipeline, well casing etc. and more particularly to a method and apparatus for providing a pulsed d.c. voltage and current to the structure.

b. Description of the Prior Art

The use of cathodic protection to prevent corrosion is well established for the protection of metal structures, such as well casings and pipe lines, that are buried in conductive soils. Cathodic protection is also used for the protection of inner surfaces of tanks which contain corrosive solutions, as well as for the protection of subplatforms, and other offshore metal structures. It is well established that the cathodic protection can be accomplished either by the use of sacrificial anodes electrically grounded to the structure to be protected, or by the application of low voltage direct current from a power source. In the latter method steady direct current, half or full wave rectified current, and pulsed direct current have all been used.

It has been well established that, when a cathodic protection current is applied to a circuit including the structure (cathode) to be protected and its associated anode, a layer of charge is formed at approximately 100 A. from the surface of the structure. This layer of charge is called a taffel double layer. This layer acts as a capacitor in series with the anode-cathode circuit.

The structure to be protected, such as a pipeline or well casing, the anode and the leads connecting such elements to the voltage source act as an inductive (as well as a resistive) load to the current flow. The soil between the anode and the structure also provides a resistive load of less than one to several ohms.

In the absence of a cathodic protection system the soil or other conductive corrosive medium to which a ferrous metal structure such as a steel pipeline is exposed will cause an adverse chemical reaction in which ferrous or iron molecules pass into solution as positive ions by surrendering electrons to the structure. Hydrogen ions in the solution will accept the free electrons and form a gas e.g. $H_2$ adjacent to the surface of the structure. Oxygen molecules and certain other substances, if present in the solution, will also accept the electrons. This action results in a loss of iron in the structure with a consequent degradation of structural integrity.

Direct current cathodic protection systems prevent (or inhibit) the iron molecules from passing into solution by providing an exterior source of free electrons to the structure. The electrons supplied by the cathodic protection systems reduce any oxygen molecules and/or hydrogen ions present at the surface of the structure. The iron molecules are inhibited from going into solution, because the hydrogen ion and oxygen molecule receptors for the iron molecule electrons have been reduced by the cathodic protection system electrons. As a general rule, the greater the amount of current (accumulated electrons per unit of time) that is supplied by the cathodic protection system, the greater will be the area of structure protected.

A typical steady state 15 volt and 15 ampere d.c. cathodic protection system offers good protection but provides only a limited umbrella of protection or throw along the structure such as a pipeline to be protected. Such steady state systems thus require a considerable number of protection stations for a given length of the structure or pipe to be protected. Increasing the amount of current supplied by increasing the voltage, will increase the throw. The average current must, however, be limited such that an excess of hydrogen gas is not generated at the point of application of the cathodic protection system. An excess of hydrogen may cause damage to protective coatings. Excess hydrogen will also permeate the pipe wall, causing certain pipe materials to crack or rupture.

It has been shown that a pulsed d.c. voltage source having an output of the order of 100–300 volts for 5–100 microseconds ("μs") with a duty cycle of the order of 10% provides a much greater coverage (or throw) per station e.g. one station every few miles of pipeline. Such pulsed systems have been considered to be particularly effective because, although the average current is still in the order of magnitude of 15 amperes, the peak current, which is flowing for a sufficient length of time to cause the protective reactions to take place, will be typically as high as 300 amperes. The pulsed d.c. systems also cause a greater redistribution of the current along the structure, such as a pipeline, because of the inductive and capacitive reactance of the anode and structure system.

A major problem which occurs in the prior art cathodic protection systems is the stray current interference of the systems when two or more structures are located adjacent or near each other. This problem is best illustrated in FIG. 1 of the drawings where reference numeral 10 designates a pulsed d.c. source such as those described in U.S. Pat. Nos. 3,612,898 and 3,692,650 of which I am named as a co-inventor. The d.c. source is connected across a positive terminal 12 and a negative terminal 14 which terminals are in turn connected by appropriate leads to an anode device 16 and the structure to be protected such as a pipeline 18 which acts as the cathode. The anode device generally consists of several discrete metal cylinders connected in parallel and spaced from each other in one or more holes extending several hundred feet below ground level. A diode 20 is connected across the positive and negative terminals to allow the current induced by the emf resulting from inductive reactance of the anode-cathode load at the end of the voltage pulse to pass freely from the negative to the positive terminal. This arrangement prevents the negative terminal 14 from going positive with respect to the terminal 16 (except for the very small diode breakdown voltage) and thus protects the voltage source from a reverse voltage spike. However, the arrangement allows current (represented by waveform $I_1$ in FIG. 1) to continue to flow in the load for a considerable time after the termination of the voltage pulse (represented by waveform $V_1$ in FIG. 1).

Pulsed current flowing in the anode/cathode circuit or load, although less than with steady state systems, may adversely affect neighboring ferrous metal or steel structures (e.g. the pipeline 22 of FIG. 1) which intersect the anode electric field and pass near the protected structure. For example, current will flow from an area 23 of the pipeline 22 to a point 24 located opposite (and nearest) the protected pipeline 18. At point 24 iron molecules will surrender electrons to the pipe 22 to satisfy the current demand and go into solution. As a result a hole will be formed at point 24 taking the pipeline 22 out of service until an appropriate repair is made.

A sacrificial anode may be placed on the pipeline 22 near the point 24 or the two pipelines may be connected by a conductive wire to prevent the perforation of the metal. However, sacrificial anodes must be replaced and a wire connection between the structures will reduce the area of protection for pipeline 18 (and perhaps pipeline 22) and create additional problems in the event that the protection system for either pipeline is inactivated. The liability problems resulting from damage to neighboring pipelines can be very significant.

There is a need to reduce or eliminate the current flow due to the inductive reactance in a pulsed d.c. cathodic protection systems to thereby minimize any adverse affects on neighboring ferrous metal structures.

SUMMARY OF THE INVENTION

A circuit and method of cathodically protecting a conductive structure such as a metal pipeline or well casing immersed in a conductive medium, such as the ground, in accordance with the present invention includes locating an anode in the medium through which current may be passed to the structure to be protected. The anode, medium and structure form an electrical load having an impedance including an inductive reactance to current flow therethrough. A pair of input terminals are provided with one terminal being connected to the anode and the other terminal being connected to the structure. A source of d.c. voltage is periodically connected across the terminals so that the positive terminal is connected to the anode and the negative terminal is connected to the structure to periodically cause current to flow through the anode, the conducting medium and the structure. The current flow between the input terminals due to the induced emf caused by the inductive reactance of the load is limited by providing a high impedance, e.g. an open circuit, between the input terminals during all or part of the time that the d.c. source is not supplying current to the anode/cathode load.

The features of the present invention can best be understood by the following description taken in conjunction with the accompanying drawings in which like components are designated by like reference numerals.

DESCRIPTION OF THE PREFERRED EMBODIMENT

Figure 2:
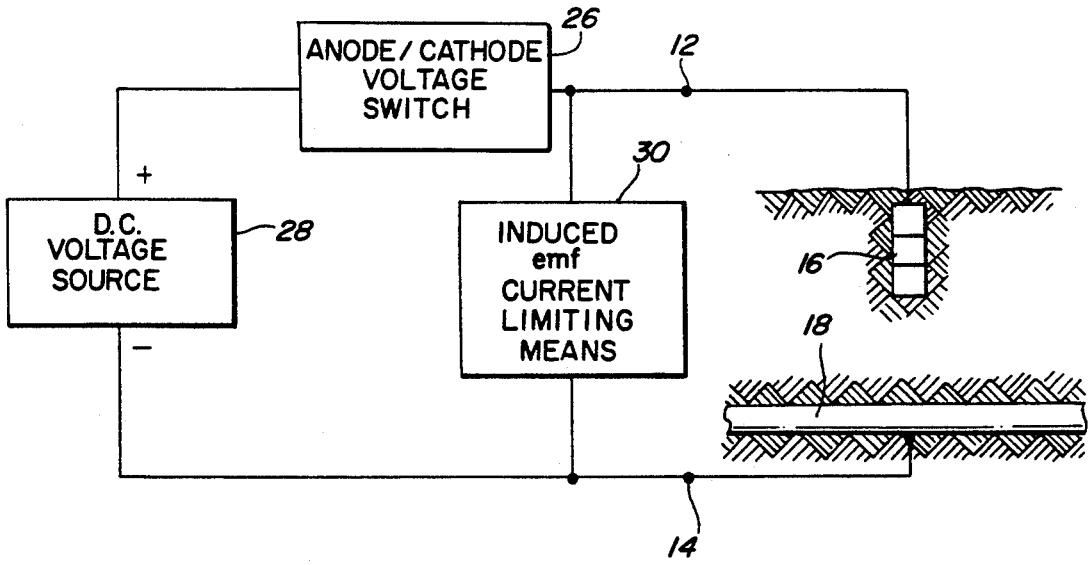
FIG. 2 is a block diagram of a cathodic protection system in accordance with the present invention.

Referring now to the drawings and more particularly to FIG. 2, an anode/cathode voltage switch 26 is connected between the positive terminal of a suitable d.c. voltage source 28 and the input terminal 12. The negative terminal of the voltage source 28 is connected to the input terminal 14. The voltage source may provide any suitable output voltage e.g. 100–300 volts. A source of 150 volts may be readily obtained from a conventional 120 volt outlet using a full wave rectifier and a suitably large filter capacitor, e.g. 100 or more $\mu$f, to maintain the output voltage relatively constant.

A conventional anode/cathode voltage switch 26 is connected in series between the voltage source and the input terminals to provide a pulsed d.c. voltage across the terminals. As shown, the switch 26 is connected between the positive terminal of the voltage source and the input terminal 12. However, the switch may be connected between the negative terminal of the voltage source and the terminal 14 if desired. The switch 26 is arranged to gate d.c. voltage pulses across the input terminals at an appropriate gating frequency such as less than 1 to 5 or more KHz. The voltage pulse should have a short duration, for example, of the order of 5 to 100 $\mu$s and an appropriate duty cycle to ensure that enough current is supplied to the anode/cathode load to inhibit the adverse iron molecule/iron ion reaction while preventing the flow of too much average current which may cause undesirable chemical reactions such as the formation of excessive amounts of free hydrogen. Depending on the nature of the anode/cathode load, I have found that an average current flow of about 15 amperes with a peak current flow of 150 amperes provides good protection while minimizing adverse chemical reactions. A voltage pulse duration of the order of 5 to 30 $\mu$s with a duty cycle of about 10% is preferred.

Once the voltage source 28 is disconnected from the anode/cathode load the emf induced by the inherent inductance in the system causes a reversal of the potential across the input terminals. To limit the current flow between such terminals caused by this back emf and thereby minimize the damage to neighboring pipelines or other structures a current limiting device 30 is connected across the terminals 12 and 14. The current limiting device 30 may be arranged to limit the induced current by simply inserting an impedance (e.g. a resistance diode arrangement) between the input terminals when the voltage reverses polarity. To conserve energy the current limiting means 30 is preferably in the form of a switch which is open during all or a portion of the time that the voltage source is disconnected from the input terminals. In the former arrangement (where the switch is open during all of the time that the voltage source is disconnected) an open circuit is provided across the input terminals to prevent induced current flow through the terminals. In the latter arrangement (where the switch is closed a portion of the time) a closed circuit is provided across the input terminals for a predetermined time interval between voltage pulses from the d.c. source. For example, the switch may be arranged to conduct (or provide a low impedance path between the input terminals) a predetermined time interval after the voltage source has been disconnected.

Figure 1:
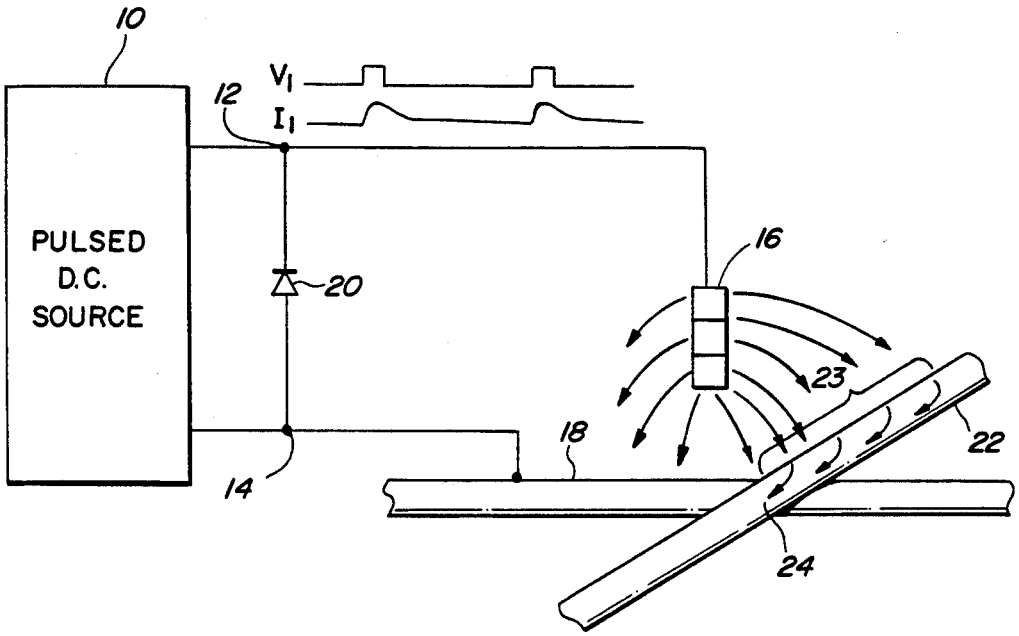
FIG. 1 PRIOR ART
FIG. 1 is a block diagram of a prior art cathodic protection apparatus as discussed previously.
Figure 3:
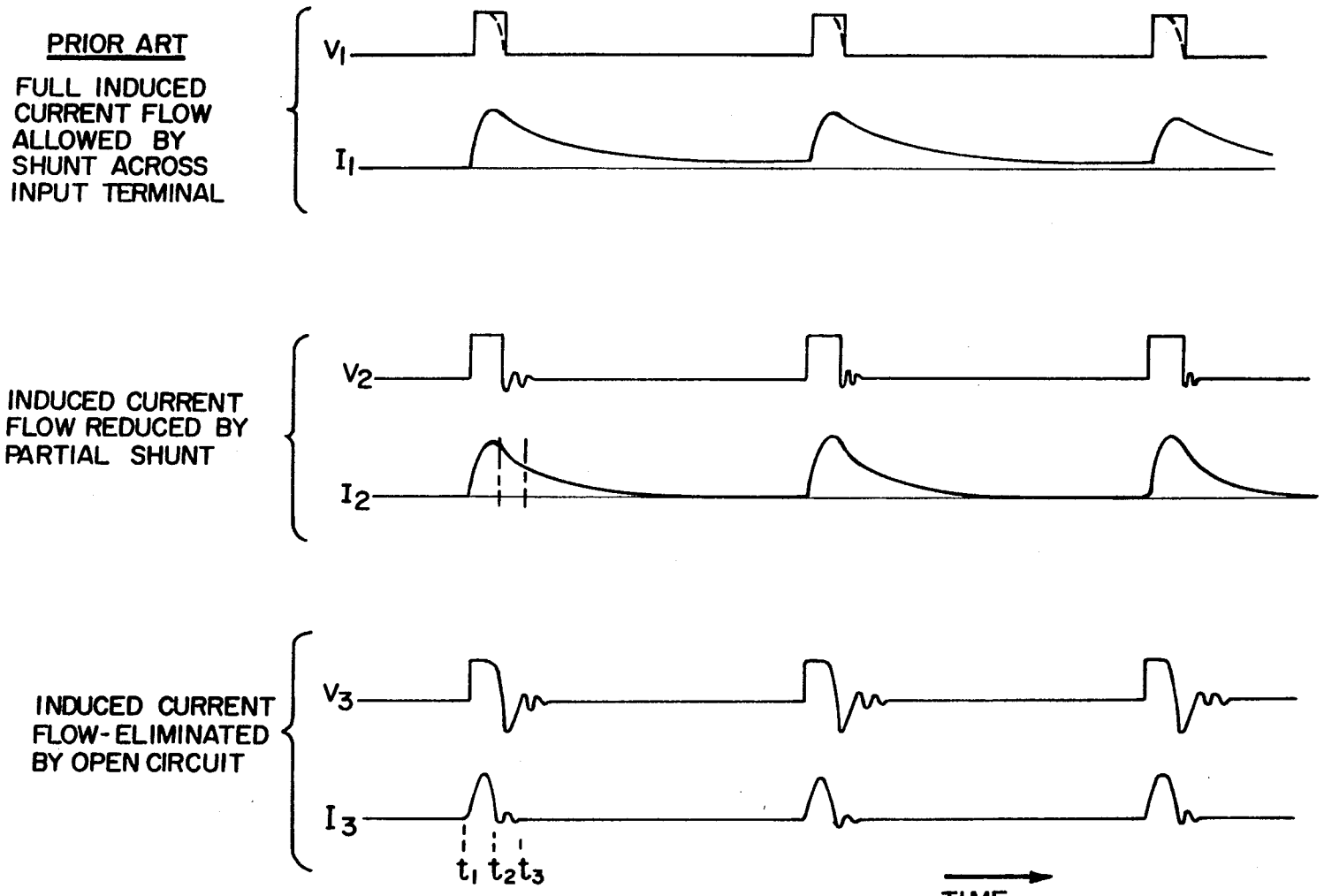
FIG. 3 is a waveform diagram illustrating the voltages across and the current flows through the input terminals of prior art pulsed voltage cathodic protection systems and circuits in accordance with the present invention.

Referring now to FIG. 3 the voltage and current waveforms associated with the circuits of FIGS. 1 and 2 are illustrated. The waveforms $V_1$ and $I_1$, represent the voltage across and the current through the input terminals 12 and 14 of the prior art circuit of FIG. 1. As will be noted the voltage waveform $V_1$ is of the square wave type. However, where silicon controlled rectifiers (SCRs) are used as the switching elements, the voltage waveform will take the shape shown by the dotted lines since a power capacitor necessary for turning off the SCRs, must discharge from its peak value to the turn off voltage. The current waveform $I_1$ illustrates how the induced emf causes current to continue to flow through the input terminals (via diode 20) while the field associated with the inherent inductance of the load decays.

Waveforms $V_2$ and $I_2$ represent the voltage across and current through the input terminals of the circuit of FIG. 2 when the induced current limiting means 30 is in the form of a switch which provides a short circuit across the input terminals only after a predetermined time delay (i.e. $t_2$ to $t_3$) from the end of the voltage pulse $V_2$. As will be noted, the total current flow due to the induced emf has been significantly reduced from that present in the circuit of FIG. 1.

Waveforms $V_3$ and $I_3$ represent the voltage across and current through the input terminals of the circuit of FIG. 2 when the induced current limiting means provides an open circuit across the input terminals. As will be noted with this arrangement, there is a significant inverse voltage spike (of a magnitude approaching the initial input voltage $V_3$)across the input terminals following the disconnection of the voltage source. Such an inverse voltage may not be tolerated by some anode/-cathode switching elements thus requiring the use of the switch discussed above for connecting the input terminals together a short time after the end of the d.c. voltage pulse.

Figure 4:
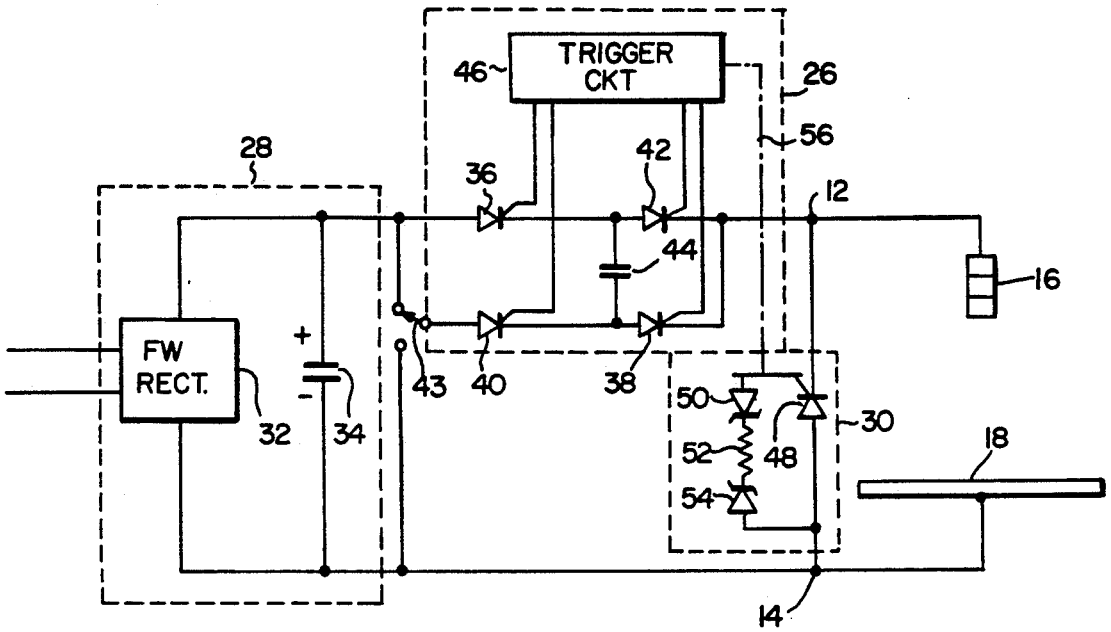
FIG. 4 is a schematic circuit diagram of a anode/-cathode voltage switch and an induced emf current switch which may be used in the circuit of FIG. 2.

Referring now to FIG. 4, examples of an anode/cathode voltage switch 26 and an induced emf current limiting switch 30 are illustrated. The d.c. voltage source comprises a conventional full wave rectifier 32 having its input connected to an a.c. outlet, e.g. 120 volts, and an output connected across a conventional filter capacitor 34 having a large capacitance, e.g. 100–300 μf or more. The voltage switch 26 includes two pairs of SCRs 36, 38 and 40, 42, a power capacitor 44 and a magnitude selection switch 43. When the switch 43 is in the position shown (i.e., anodes of SCRs 36 and 40 connected together) the power capacitor 44 is connected in series between the positive voltage source terminal and the input terminal 12 during each half cycle to provide a peak voltage across the input terminals which is twice the voltage (across the filter capacitor or about 300 volts where a 120 volt outlet is connected to the full wave rectifier). A trigger circuit 46 fires SCRs 36 and 38 during one half cycle and fires SCRs 40 and 42 during the other half cycle in a conventional manner. This action charges and discharges power capacitor 44 positively and negatively resulting in a doubling of the voltage across capacitor 44.

When the voltage magnitude selection switch is operated to connect the anode of SCR 40 to the negative voltage source terminal the power capacitor is charged only in one direction and therefore the peak voltage across the input terminals 12 and 14 will be equal to the voltage across the filter capacitor i.e. 150 volts where a 120 volt outlet is connected to the full wave rectifier. The magnitude selection switch allows the operator to select an appropriate system voltage for the particular anode/cathode load. It should be noted that in lieu of the switch 43 a lead may be used to connect the anode of SCR 40 to the positive or negative terminal of the d.c. source.

The current limiting switch 30 of FIG. 4 includes an SCR 48 connected as shown between the input terminals. A zener diode 50 is connected in series with a resistor 52 and a diode 54 between the SCR gate and the terminal 14. The zener diode 50 may have any selected voltage breakdown value so that in conjunction with the resistor 52 and the diode 54, the gate-cathode junction of the SCR will become forward biased and allow the SCR to conduct after a selected time delay from the termination of the voltage pulse from the d.c. source. The SCR 48 will continue to conduct until the induced voltage reaches zero.

If desired the SCR 48 may be controlled directly by the trigger circuit 46 in lieu of the zener diode arrangement, as is illustrated by the dashed lead line 56. The lead 56 connects an output signal (appropriately delayed from the gating signal to the SCR's 36–42) from the circuit 46 to the gate of SCR 48. While a resistance could be used to limit the induced emf current such an arrangement would be wasteful of energy.

Figure 5:
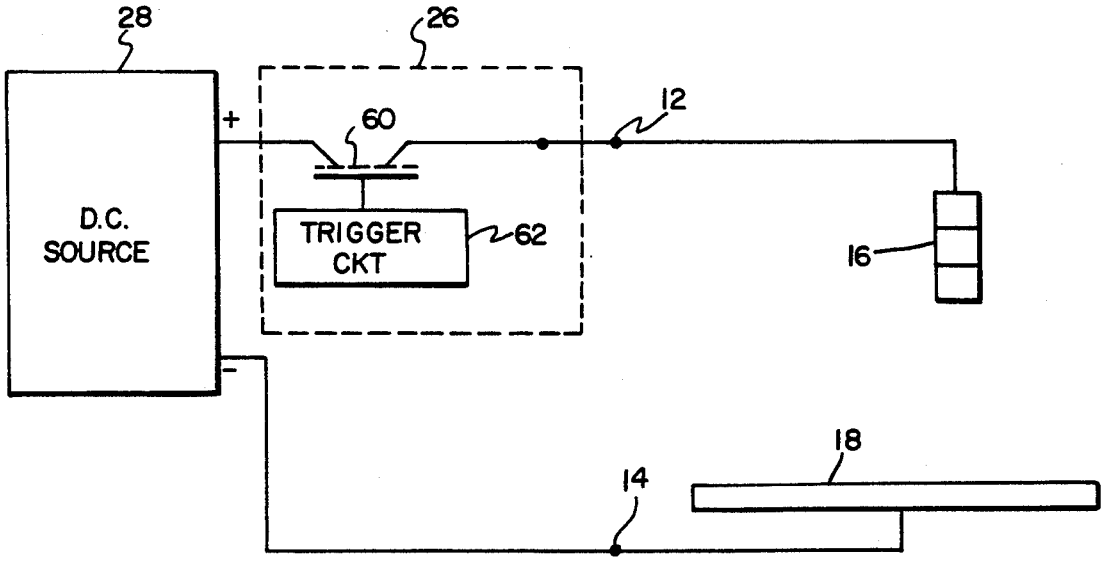
FIG. 5 is a schematic circuit diagram of another type of anode/cathode switch which may be used in the circuit of FIG. 2.

FIG. 5 illustrates the use of an isolated gate bipolar transistor or IGBT 60 and a trigger circuit 62 as the anode/cathode voltage switch. This type of semiconductor switch has an advantage over SCRs in not requiring the use of a power capacitor for terminating the current flow. This type of switch will also provide a square wave voltage pulse to the anode/cathode load since the discharge characteristic of a power capacitor is absent. On the other side of the coin IGBTs may degrade in time when exposed to high peak voltages. In this embodiment the emf current limiting means is in the form of an open circuit across the input terminals 12 and 14 for eliminating the current flow due to the induced emf.

It should be noted that the voltage source 28 is considered to be disconnected from the input terminals 12 and 14 when the current through the load is no longer being driven by the source 28 but instead by the back emf. Where SCR's are used as the switching elements (26) as is illustrated by FIG. 4, the back emf will cause some current to continue to flow through the SCR's (36, 38 or 40, 42) and capacitor 44 after the termination of the voltage pulse.

It should also be noted that in addition to the protection afforded neighboring pipelines the inhibition of current flow through the input terminals between pulses from the d.c. source 28 also results in more current being redistributed along the pipeline 18. When a d.c. voltage is applied to the anode/structure-cathode system, current begins flowing in the various conductors in the system and particularly in the metal pipeline. Also, a magnetic field, whose strength is proportional to the flowing current, is generated around the pipeline. The amount of current entering the pipe from the soil and thus flowing in any particular section of the pipeline, will vary depending on distance of that section to the structure-lead connection. The sections of the pipe closest to the structure-lead connection will have more current flowing in them than sections farther away. When the voltage is turned off in the prior art system of FIG. 1, the back emf of the collapsing magnetic field will cause the current in the pipe to continue flowing. The back emf will be greater on the sections of pipe near the structure-lead connection than on other sections farther along the pipeline. Some of the current driven by the back emf will continue to flow in the anode structure loop through the diode 20, but because of the back emf differential along the pipeline, and because the current will seek the least path of resistance, some of the current will leave the pipeline at points of higher back emf, flow along the outside of the pipeline and re-enter at points of lower back emf, resulting in a redistribution of current away from the structure-lead connection. Inhibiting the current from flowing through the input terminals 12 and 14 (via prior art diode 20), through the use of the current limiting device 28 of the present invention, will result in more current being redistributed along the pipeline.

There has been described an improved cathodic protection circuit and method which limits the current flow due to the induced emf caused by the inductive reactance of the load. This improvement reduces the time that adjacent structures such as pipelines are exposed to adverse current flow thereby limiting the time during which adverse chemical reactions can affect the integrity of such structures.

What is claimed is:

1. In a circuit for effecting cathodic protection of an electrically conductive structure, such as a metal pipeline, exposed to an electrically conducting medium, such as the ground, the medium being in electrical contact with an anode means, such as a plurality of spaced metal masses located in spaced relationship from the structure and through which current may be passed to said medium and to the structure, the combined anode means, conductive medium and structure to be protected forming an electrical load having an impedance including an inductive reactance to current flow therethrough, the combination comprising:

a pair of input terminals;

a first lead connecting one of the input terminals to the anode means;

a second lead connecting the other input terminal to the structure;

a source of d.c. voltage having positive and negative terminals; and first switching means connected between the d.c. source and the input terminals for periodically connecting the d.c. voltage source across the input terminals so that the positive terminal is connected to the anode means and the negative terminal is connected tot he structure to periodically cause current to flow through the anode means, the conducting medium and the structure;

induced emf current limiting means connected across the input terminals for providing a high impedance across the input terminals during at least a portion of the time that the d.c. source is disconnected from the input terminals thereby limiting the current flow from one terminal to the other due to the induced emf caused by the inductive reactance of the load.

2. The circuit of claim 1 wherein the current limiting means includes second switching means connected across the input terminals, the second switching means being arranged to provide a substantially open circuit across the input terminals during a portion of time that the d.c. source is disconnected from the input terminals and a substantially short circuit across said terminals during the remainder of the time that the d.c. source is disconnected from the input terminals.

3. The circuit of claim 2 wherein the second switching means includes a zener diode.

4. The circuit of claim 3 wherein the second switching means includes a semiconductor switch connected across the input terminals.

5. The circuit of claim 4 wherein the semiconductor switch is an SCR comprising a gate electrode, and a resistor and said zener diode being connected in series between one of the input terminals and the SCR gate electrode.

6. In a circuit for effecting cathodic protection of an electrically conductive structure, such as a metal pipeline, exposed to an electrically conducting medium, such as the ground, the medium being in electrical contact with an anode means, such as a plurality of spaced metal masses located in spaced relationship from the structure and through which current may be passed to said medium and to the structure, the combined anode means, conductive medium and structure to be protected forming an electrical load having an impedance including an inductive reactance to current flow therethrough, the combination comprising:

a pair of input terminals;

a first lead connecting one of the input terminals to the anode means;

a second lead connecting the other input terminal to the structure;

a source of d.c. voltage having positive and negative terminals;

first switching means connected between the d.c. source and the input terminals for periodically connecting the d.c. voltage source across the input terminals, so that the positive terminal is connected to the anode means and the negative terminal is connected to the structure, to periodically cause current to flow through the anode means, the conducting medium and the structure; and second switching means connected across the input terminals for providing an open circuit across the input terminals during at least a portion of the time that the d.c. source is disconnected from the input terminals for preventing current due to the induced emf caused by the inductive reactance of the load from flowing from one terminal to the other during said time, whereby the current flow between the anode and the structure is limited in time.

7. The cathodic protection circuit of claim 6 wherein the first switching means includes a power capacitor, a first pair of SCRs and a second pair of SCRs, the first pair of SCRs being connected in series with the power capacitor between the positive terminal of the d.c. voltage source and said one input terminal and means for selectively connecting the second pair of SCRs in series with the power capacitor between one of the positive and negative terminals of the d.c. voltage source and said one input terminal, whereby the voltage impressed across the input terminals may be the same or twice the magnitude of that of the d.c. voltage source.

8. The circuit of claim 7 wherein the second switching means is arranged to provide a substantially short circuit across the input terminals during another portion of time that the d.c. source is disconnected from the input terminals.

9. The circuit of claim 8 wherein the second switching means includes an SCR connected across the input terminals.

10. In a circuit for effecting cathodic protection of an electrically conductive structure, such as a metal pipeline, exposed to an electrically conducting medium, such as the ground, the medium being in electrical contact with an anode means, such as a plurality of spaced metal masses located in spaced relationship from the structure and through which current may be passed to said medium and to the structure, the combined anode means, conductive medium and structure to be protected forming an electrical load having an impedance including an inductive reactance to current flow therethrough, the combination comprising:

a pair of input terminals;

a first lead connecting one of the input terminals to the anode means;

a second lead connecting the other input terminal to the structure;

a source of d.c. voltage having positive and negative terminals;

switching means connected between the d.c. source and the input terminals for periodically connecting the d.c. voltage source across the input terminals, so that the positive terminal is connected to the anode means and the negative terminal is connected to the structure, to periodically cause current to flow through the anode means, the conducting medium and the structure, the switching means comprising a power capacitor, a first pair of SCRs and a second pair of SCRs, the first pair of SCRs being connected in series with the power capacitor between the positive terminal of the d.c. voltage source and said one input terminal and means for selectively connecting the second pair of SCRs in series with the power capacitor between one of the positive and negative terminals of the d.c. voltage source and said one input terminal, whereby the voltage impressed across the input terminals may be the same or twice the magnitude of that of the d.c. voltage source and;

induced emf current limiting means connected across the input terminals for providing a high impedance across the input terminals during at least a portion of the time that the d.c. source is disconnected from the input terminals thereby limiting the current flow from one terminal to the other due to the induced emf caused by the inductive reactance of the load.

* * * * *

UNITED STATES PATENT AND TRADEMARK OFFICE

CERTIFICATE OF CORRECTION

PATENT NO. : 5,324,405

DATED : June 28, 1994

INVENTOR(S) : Doniguian

It is certified that error appears in the above-identified patent and that said Letters Patent is hereby corrected as shown below:

Column 7, line 41, "tot he" should read -- to the --.

Signed and Sealed this

Fourth Day of October, 1994

Bruce Lehman

*Attest:*

BRUCE LEHMAN

*Attesting Officer*

*Commissioner of Patents and Trademarks*